US006489580B2

(12) United States Patent
Yanai et al.

(10) Patent No.: US 6,489,580 B2
(45) Date of Patent: Dec. 3, 2002

(54) PUSH-ON SWITCH, ELECTRONIC APPARATUS USING THE SAME AND METHOD FOR MOUNTING THE SWITCH

(75) Inventors: Yasunori Yanai, Okayama (JP); Hisashi Watanabe, Okayama (JP); Koji Sako, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 2 days.

(21) Appl. No.: 09/767,844

(22) Filed: Jan. 24, 2001

(65) Prior Publication Data

US 2001/0013466 A1 Aug. 16, 2001

(30) Foreign Application Priority Data

Jan. 25, 2000 (JP) ..... 2000-015167

(51) Int. Cl.[7] ..... H01H 13/52; H01H 9/00

(52) U.S. Cl. ..... 200/406; 200/513; 200/520; 200/534; 200/292

(58) Field of Search ..... 200/406, 512–517, 200/302.1–302.3, 292, 520–534, 622, 832

(56) References Cited

U.S. PATENT DOCUMENTS 3,272,951 A * 9/1966 O'Brien ..... 200/292 X
4,331,851 A * 5/1982 Johnson ..... 200/517
4,535,534 A * 8/1985 Ohashi et al. ..... 29/832
4,739,139 A * 4/1988 Ikeda ..... 200/294
4,894,498 A * 1/1990 Kagawa et al. ..... 200/284
6,100,484 A * 8/2000 Houze et al. ..... 200/512

FOREIGN PATENT DOCUMENTS

JP 5-1126 1/1993

* cited by examiner

*Primary Examiner*—J. R. Scott
(74) *Attorney, Agent, or Firm*—Wenderoth, Lind & Ponack, L.L.P.

(57) ABSTRACT

A push-on switch includes an insulating resin case 21 which contains a main body 24, a central fixed contact point 22 and an outer fixed contact point 23 fixed on the back wall of a front-open recess 21A; a domed movable contact 27; and an operating body 29 supported by a cover 30. The case 21 has an overhang 25, which stretches horizontally from the case in the upper part to be of a size greater than the size of main body 24. The overhang 25 is provided with terminals 26 electrically coupled with the central fixed contact point 22 and the outer fixed contact point 23, respectively. In the above-configured switch, the constituent parts are simplyformed, and can be manufactured through easy mold machining or other processing methods.

24 Claims, 18 Drawing Sheets

PUSH-ON SWITCH, ELECTRONIC APPARATUS USING THE SAME AND METHOD FOR MOUNTING THE SWITCH

FIELD OF THE INVENTION

The present invention relates to a side-push type push-on switch for use in operating sections of various kinds of electronic apparatus. A method for mounting the switch is also included.

BACKGROUND OF THE INVENTION

There is an increasing need for inexpensive push-on switches that can be operated with a sidewise push force, or an operating force exerted in a direction parallel to the surface plane of a printed circuit board. Also, in view of the prevailing trends for downsized equipment and the preference for slim-shaped designs in the market of electronic apparatus, switches for such apparatus are requested to be small enough to satisfy various designing requirements.

A side-push type push-on switch known to meet the above-described general requirements is disclosed in Japanese Utility Model Laid-open Publication No. 51126.

FIG. 15 shows a cross-sectional side view of a conventional push-on switch, and FIG. 16 is an exploded perspective view. As shown in FIG. 16, a resin case 1 that opens upward is provided in its inner recess with a pair of outer fixed contact points 2 and a central fixed contact point 3 formed integrally by insert molding. The respective fixed contact points 2 and 3 are electrically coupled with terminals 4 provided on an outside wall surface of the resin case 1.

A rectangular movable contact 5 made of an elastic thin metal sheet is formed of a frame 5A and a bridging arch 5B disposed in the middle of the frame 5A. The movable contact 5 is placed so that the frame 5A makes contact with the outer fixed contact points 2.

The bridging arch 5B of movable contact 5 is held above the central fixed contact point 3 with a certain specific clearance.

Placed further above are a flexible anti-dust sheet 6 made of an insulating resin and an operating member 7.

The operating member 7 consists of an operating section 8 protruding toward the front from an opening 1A of side wall of case 1, and a flat plate section 9 formed integrally behind the operating section 8. The flat plate section 9 is provided in the middle part with a C-shaped vacancy 10 ("C-shaped" includes a square shape without one side), with its opening facing the front; the remaining central portion has a thinned area 12 at a stem region so that the central portion functions as a pushing section 11, which pushes the contacts.

The operating member 7 is placed, at the flat plate section 9, on a step existing around the recess of case 1 so that the pushing section 11 is located above the bridging arch 5B of movable contact 5.

A press board 13 is attached on the case 1 covering the flat plate section 9 of operating member 7, with claws 13A hooked to recesses 1B provided on the outer wall.

Thus the flat plate section 9 is supported between the step existing around the recess of case 1 and the bottom surface of the press board 13, and the operating member 7 can slide to-and-fro.

In the press board 13, an "L"-shaped bracket 15 is formed downward between a pair of slits 14. The steep-angled front face of bracket 15 contacts with the tip end 11A of the pushing section 11 of the operating member 7.

The above-configured conventional push-on switch is, in a normal mounting method, put on a printed circuit board and soldered, at its external connection terminals 4, with a circuit pattern (not shown) formed on the printed circuit board (not shown) of an apparatus, with the operating section 8 protruded from the front edge.

As to the operating mechanism of the conventional push-on switch, when the operating section 8 of operating member 7 protruding from the front edge of the printed circuit board is pressed towards a direction as indicated by an arrow in FIG. 15, the flat plate section 9, which is an integral part of the operating section 8, moves together along a space formed by parallel surfaces of the case 1 and the press board 13. The pushing section 11 moves in the same direction as well.

Since the pushing section 11 is in contact, at the tip end 11A, with the steep-angled front face of the bracket 15 of press board 13, the whole pushing section 11 bends downward with the thinned area 12 formed at the stem as the fulcrum. The bottom surface of tip end 11A of pushing section 11 pushes the bridging arch 5B of movable contact 5 down via the anti-dust sheet 6, and then the bridging arch 5B is reversed to mechanically contact, at its bottom surface, with the central fixed contact point 3. The outer fixed contact points 2 and the central fixed contact point 3 are made to have an electrical contact via the movable contact 5; or, the switch is brought to ON state.

When the pressure on the operating section 8 is withdrawn, the pushing section 11 is pushed back to its upper position by an elastic restorative force of the bridging arch 5B of movable contact 5, and slides along the bracket 15 to return to the original position; thus, the switch returns to the OFF state as shown in FIG. 15.

In the above-configured conventional push-on switch, the pushing section 11 needs to be provided in the operating member 7; therefore, a C-shaped vacancy 10 has to be formed in the flat plate section 9 and a thinned area 12 must be created at the stem. In order to meet the stricter requirements for downsizing, it is desired for the length of the pushing section 11 of operating member 7 to be shorter, the thickness of the thinned area 12 is to be reduced a step further, and also the size of the movable contact 5 is to be still smaller. This means that it is necessary to make more precise machining for the dies and molds, and to provide more severe controls over, for example, the flow characteristics of resin materials, the conditions for operating the molding machines, as well as the maintenance of precision dies and molds and other items. This inevitably results in a higher cost.

Conventionally, the mounted switches are fixed only by soldering the terminals 4 on a printed circuit board. Therefore, the conventional switches are vulnerable to operating forces exerted in parallel with the printed circuit board. Enhancement of the mounting strength has been an outstanding item that needs improvement with the conventional push-on switches.

The present invention addresses the above tasks for improvement, and aims to provide a compact side-push type push-on switch. Die and mold machining and preparation of constituent parts for the push-on switch of the present invention are easier and lower in total cost. In the push-on switches of the present invention, operating forces exerted onto the switch are encountered by the end-face at the edge of a printed circuit board.

SUMMARY OF THE INVENTION

A switch of the present invention comprises:

an insulating resin case containing a main body of a switch mechanism formed in a front-open cavity, where a central fixed contact point and an outer fixed contact point are fixed on the inner surface of a recess;

a domed movable contact housed in the recess, the movable contact constituting the switching contact element coupled with the fixed contact points; and an operating body supported by a cover so that it can move to-and-fro for pushing at the rear end the domed movable contact.

The resin case is provided with an overhang which stretches (extends) horizontally from the case in the upper part of a region corresponding to the main body of the switch mechanism for a distance greater than the size of main body region. The overhang is provided with terminals, electrically coupled with the central fixed contact point and the outer fixed contact point, respectively.

Thus, a complex mechanism conventionally needed for converting a sidewise operating force into a switching action is replaced by a simple structure. Namely, in a side-push type push-on switch of the present invention, the domed movable contact is pushed directly by the rear end of an operating body which can move to-and-fro in the direction of the operating force.

The constituent components of the above-configured push-on switch are of simple construction, so they can be prepared through simple and easy procedures of mold machining and/or other manufacturing processes at low cost. In addition, the push-on switch operates with a superior functional feeling.

Furthermore, the push-on switch of the present invention is mounted on a printed circuit board with the back wall of the case, in the main body region, making contact with the end-face of a cut provided in a printed circuit board while a bottom of the overhang is immediately contact on to the upper surface of the printed circuit board, and the terminals provided in the overhang are connected with respective circuit patterns on the printed circuit board. Therefore, the operating force applied to the operating body is ultimately encountered by the end-face of the printed circuit board in an area behind the main body. Thus high connection reliability is ensured in the present push-on switches with respect to the printed circuit board.

DESCRIPTION OF THE PREFERRED EMBODIMENTS

Preferred embodiments of the present invention are described in the following with reference to the drawings.

First Embodiment

Figure 1:
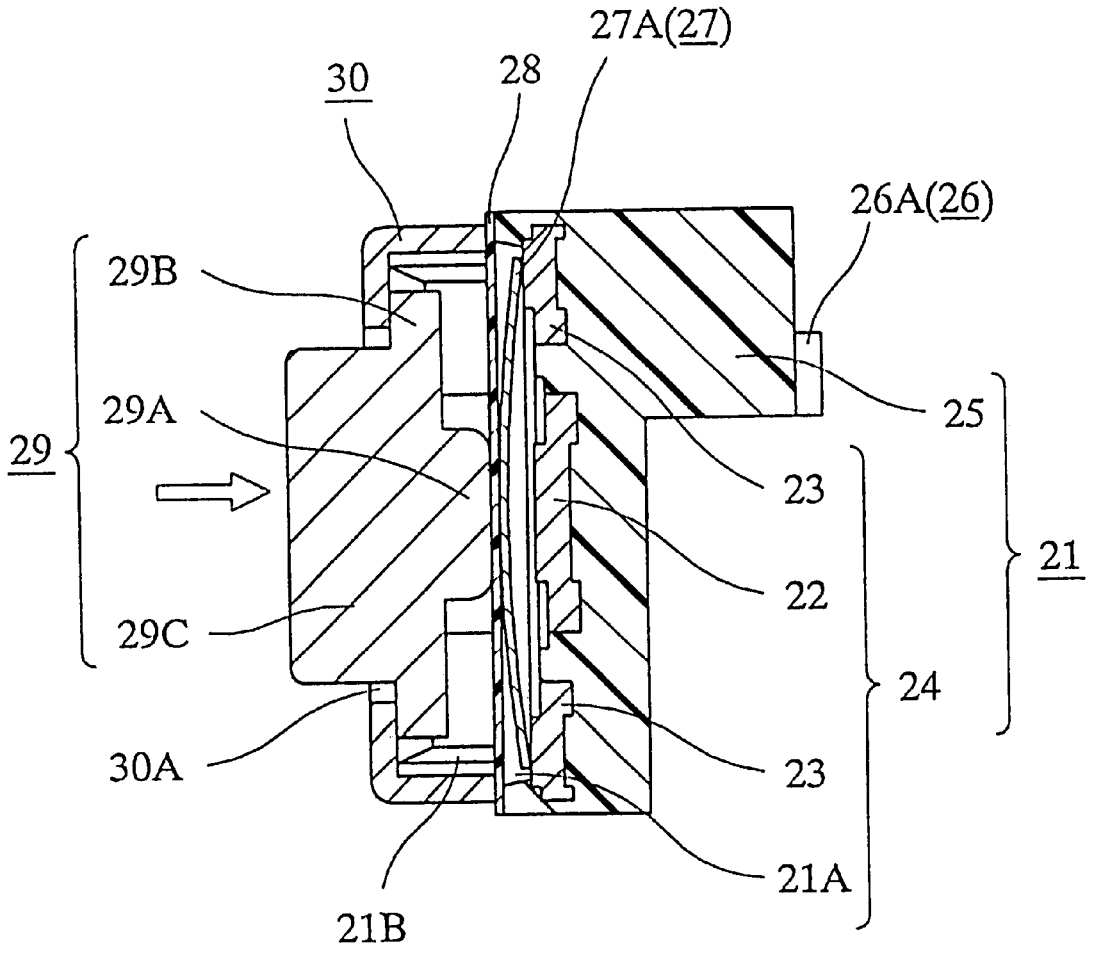
FIG. 1 is a cross-sectional view of a push-on switch in a first exemplary embodiment of the present invention.
Figure 2:
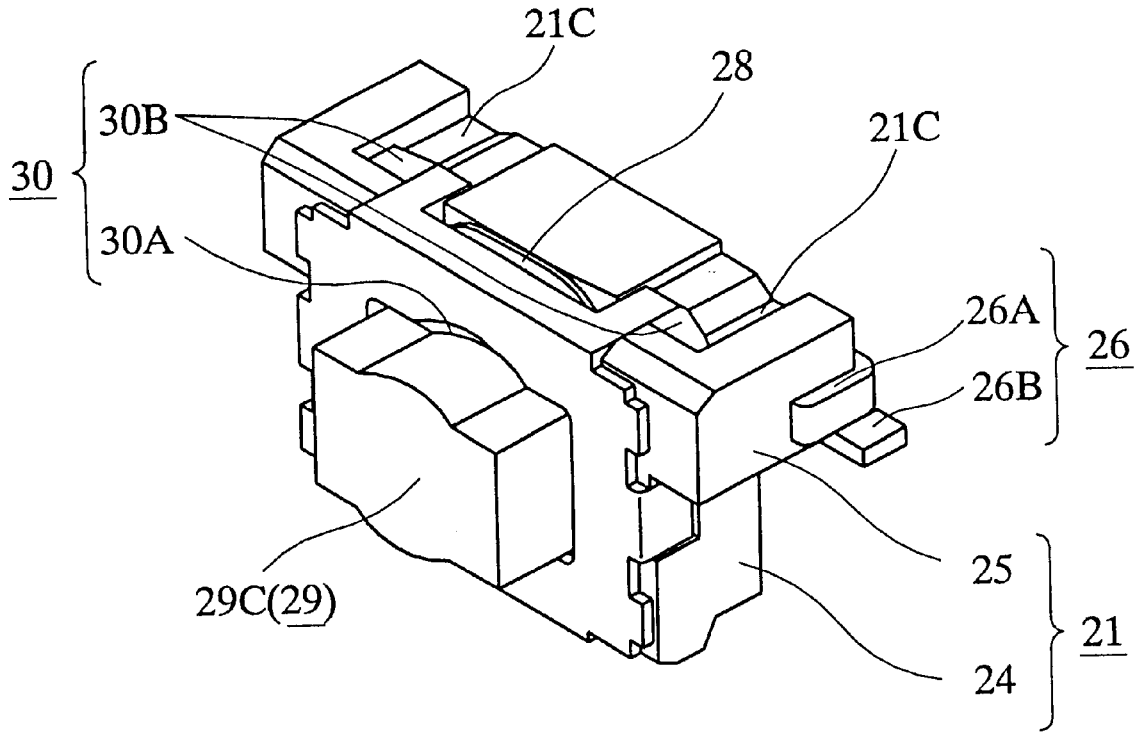
FIG. 2 is a perspective view of the push-on switch, as a finished product.

FIG. 1 shows a cross-sectional side view of a push-on switch in accordance with a first exemplary embodiment of the present invention; FIG. 2 shows a perspective view; and FIG. 3 is an exploded perspective view.

Figure 3:
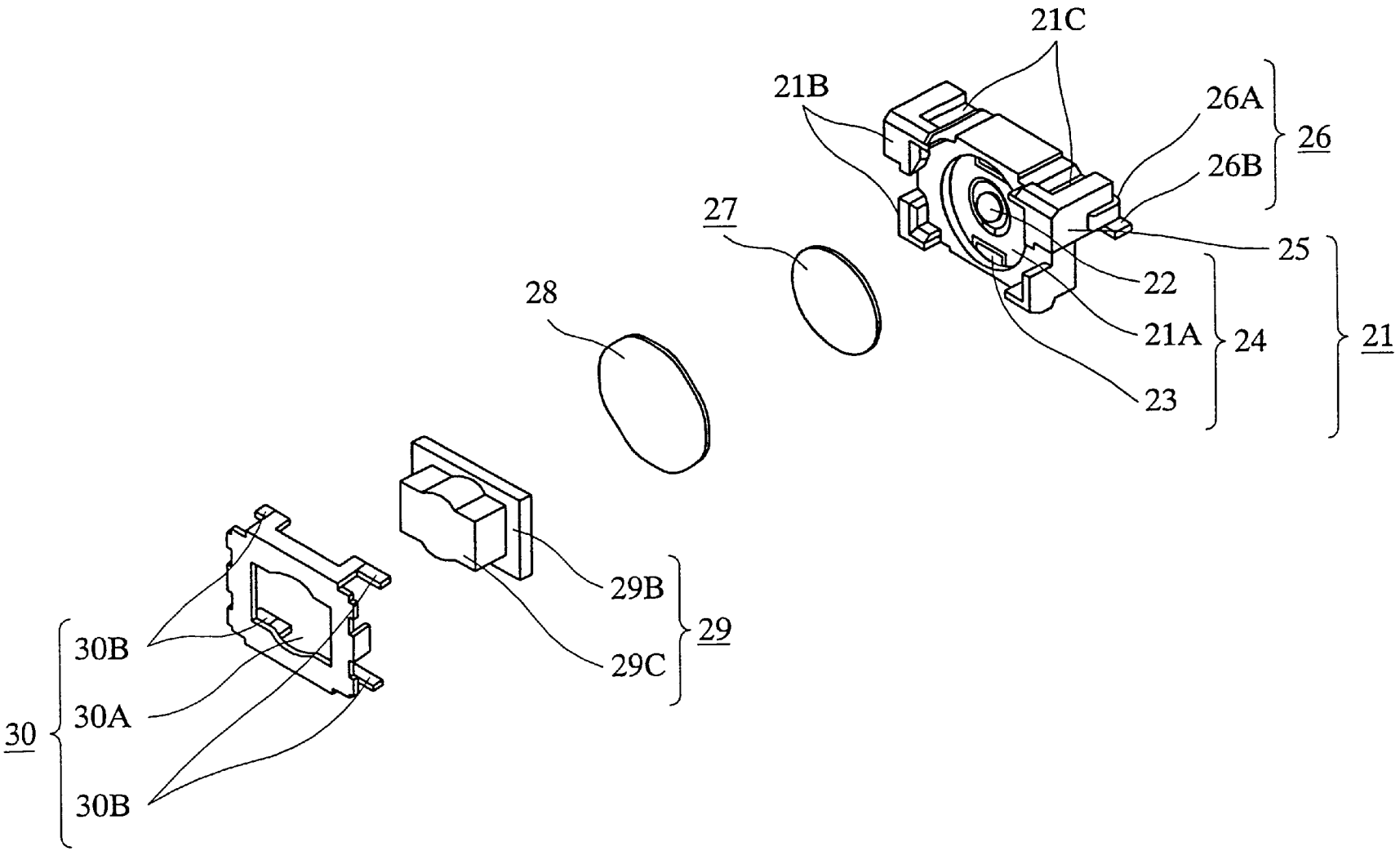
FIG. 3 is an exploded perspective view of the push-on switch.

As shown in the FIGS. 1–3, a case 21 made of an insulating resin contains a main body 24 of a switch mechanism formed in a front-open recess 21A, where a central fixed contact point 22 and two outer fixed contact points 23 disposed symmetrically at both sides of the central fixed contact point 22 are provided integrally by an insert molding method in the inner back wall of the recess so that these fixed contact points are exposed to approximately the same height from the wall surface.

The resin case 21 is provided with an overhang 25 which stretches (extends) horizontally in the directions towards both sides and towards the rear from the resin case 21 in the upper part of the main body 24 of the switch mechanism so as to have a size greater than the size of the main body.

The overhang 25 is provided in the rear comers at the right and the left with connection terminals 26, which are electrically coupled respectively with the central fixed contact point 22 and the outer fixed contact points 23. Each of the connection terminals 26 consists of a parallel part 26A which extends along the side and rear walls of overhang 25 and a protrusion part 26B which stretches sidewise from the parallel part 26A at the same level as the bottom surface of the overhang 25.

Although the connection terminal 26 is compatible with the reflow soldering by the parallel part 26A alone, the extrusion part 26B contributes to an increase in the connection stability after soldering.

A round domed movable contact 27 made of an elastic metal sheet is housed in the recess 21A of case 21 with the circumferential edge placed on the outer fixed contact points 23, so that it opposes the central fixed contact point 22 with a certain predetermined clearance between the contact point 22 and a rear surface of a dome summit 27A of contact 27.

In the front of the domed movable contact 27, a flexible insulating sheet 28 is provided for sealing the recess 21A of case 21 closed against dust and supporting the domed movable contact 27.

The insulating sheet 28 not only determines the location of the domed movable contact 27 itself, but it regulates a relative positioning of movable contact 27 with the fixed contact points 22 and 23.

The insulating sheet 28 may be provided with a pressure sensitive adhesive layer or a sticking agent layer on its surface. These layers further increase a positional accuracy of the movable contact 27 against the fixed contact points 22 and 23 and assure the long-term contact reliability.

An operating body 29 is provided in front of the domed movable contact 27, via the insulating sheet 28. The operating body 29 can move to-and-fro to push at its rear end pushing part 29A the domed movable contact 27 at the dome summit 27A.

A flange 29B of the operating body 29 can slide to-and-fro while being guided by a wall 21B protruding forward from the case 21, so the operating body 29 can move together. An operating part 29C provided in the front of flange 29B protrudes through an opening 30A of a cover 30 attached to the case 21.

The cover 30 is attached and fixed to the case 21, as shown in FIG. 2, by hooking claws 30B in trenches 21C provided in the case 21 at the right and left.

The cover 30 may be attached and fixed to the case 21 also by other means; for example, providing a dowel (not shown) at the front of case 21 and hammering it flat after it penetrates through a hole provided in the cover 30.

Now in the following, operation of the above-configured push-on switch in the present embodiment is described.

FIG. 1 shows the push-on switch in an OFF state. When the operating body 29 is pressed at operating part 29C in a direction as indicated by an arrow, the operating part 29C moves straight, without any dislocation or tilting, in the direction of the arrow, guided at the flange 29B by the inner surface of wall part 21 B of case 21. Pushing part 29A of the operating body 29 pushes, via insulating sheet 28, the domed movable contact 27 at the dome summit 27A.

Figure 4:
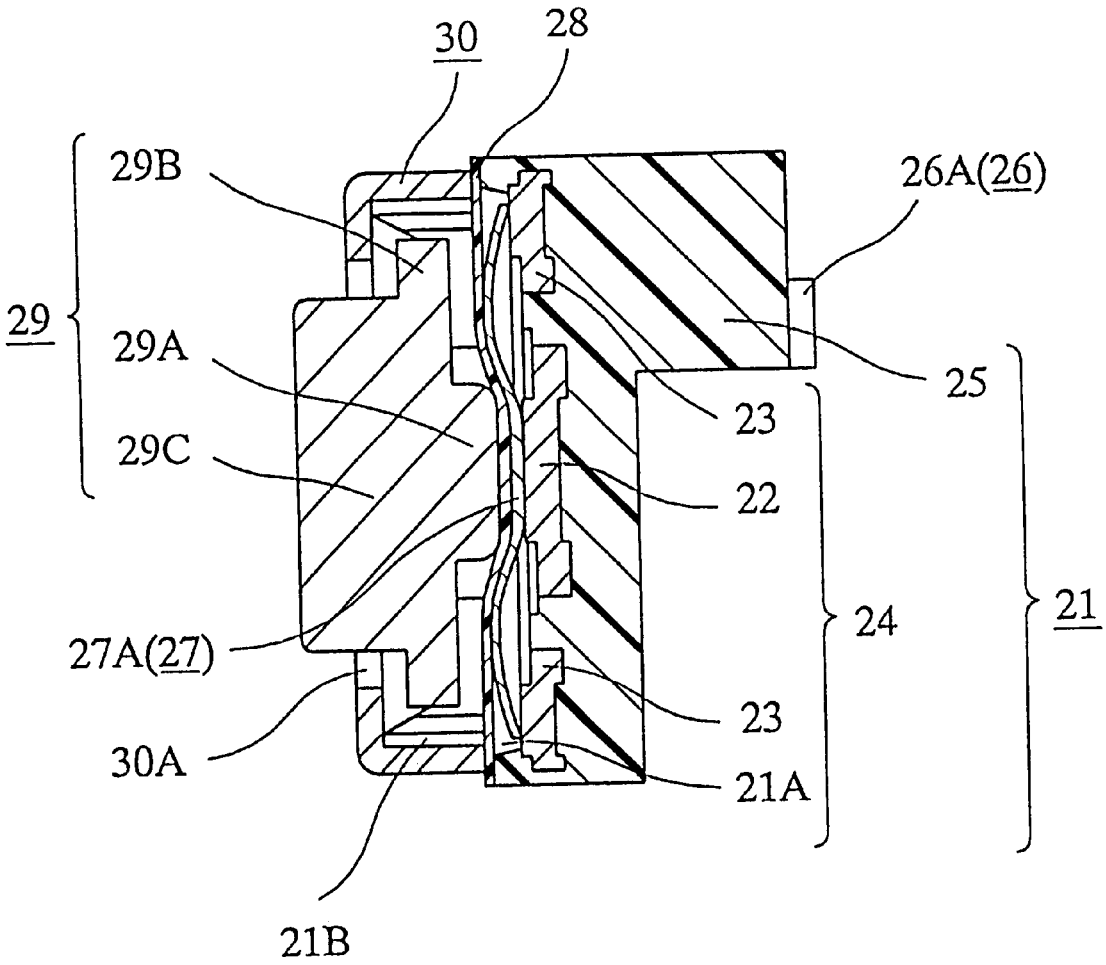
FIG. 4 is a cross-sectional view of the push-on switch, in a state of being pushed.

When the strength of the pressing force goes beyond a certain level, the domed movable contact 27 reverses, which is accompanied a click feeling, to contact with the central fixed contact point 22 at the rear surface at dome summit 27A. Thus the central fixed contact point 22 and the outer fixed contact points 23 are brought into electrical conduction via the domed movable contact 27. The two terminals 26 provided in the overhang 25 are brought into electrical contact accordingly. Now the push-on switch is ON, as shown in FIG. 4.

The domed movable contact 27 is regulated in the position by the insulating sheet 28 and kept in a certain predetermined position during the pressing operation; therefore, 1) a clear click-feeling is generated every time when it is pushed with a certain force, providing a stable electrical contact between the central fixed contact point 22 and the outer fixed contact points 23, and
2) the operational action of pushing proceeds smoothly, since there is no slide resistance between the pushing part 29A of operating body 29 and the upper surface of domed movable contact 27.

When the pressure exerted on the operating body 29 is withdrawn, the domed movable contact 27 restores its original shape with a self restorative elastic force, and returns the operating body 29 to the initial location, bringing the switch to its OFF state as shown in FIG. 1.

At this state, since the front surface of flange 29B is in contact with the rear surface of cover 30, the operating body 29 rests at a certain predetermined position.

As described above, in a push-on switch in the present embodiment, when an operating force is applied to the operating part 29C, the operating body 29 moves in the same direction in which the operating force is applied and the pushing part 29A, which is the rearmost part of the operating body 29, pushes the domed movable contact 27 directly. Thus the push-on switch has a simple structure, using simple constituent components. They can be manufactured through an easy mold machining or other machining processes at low cost. The above-configured side-push type push-on switch provides also a superior feeling of operation.

Next, a method for mounting a push-on switch in the present embodiment, as well as an electronic apparatus containing the push-on switch, are described.

Figure 5A:
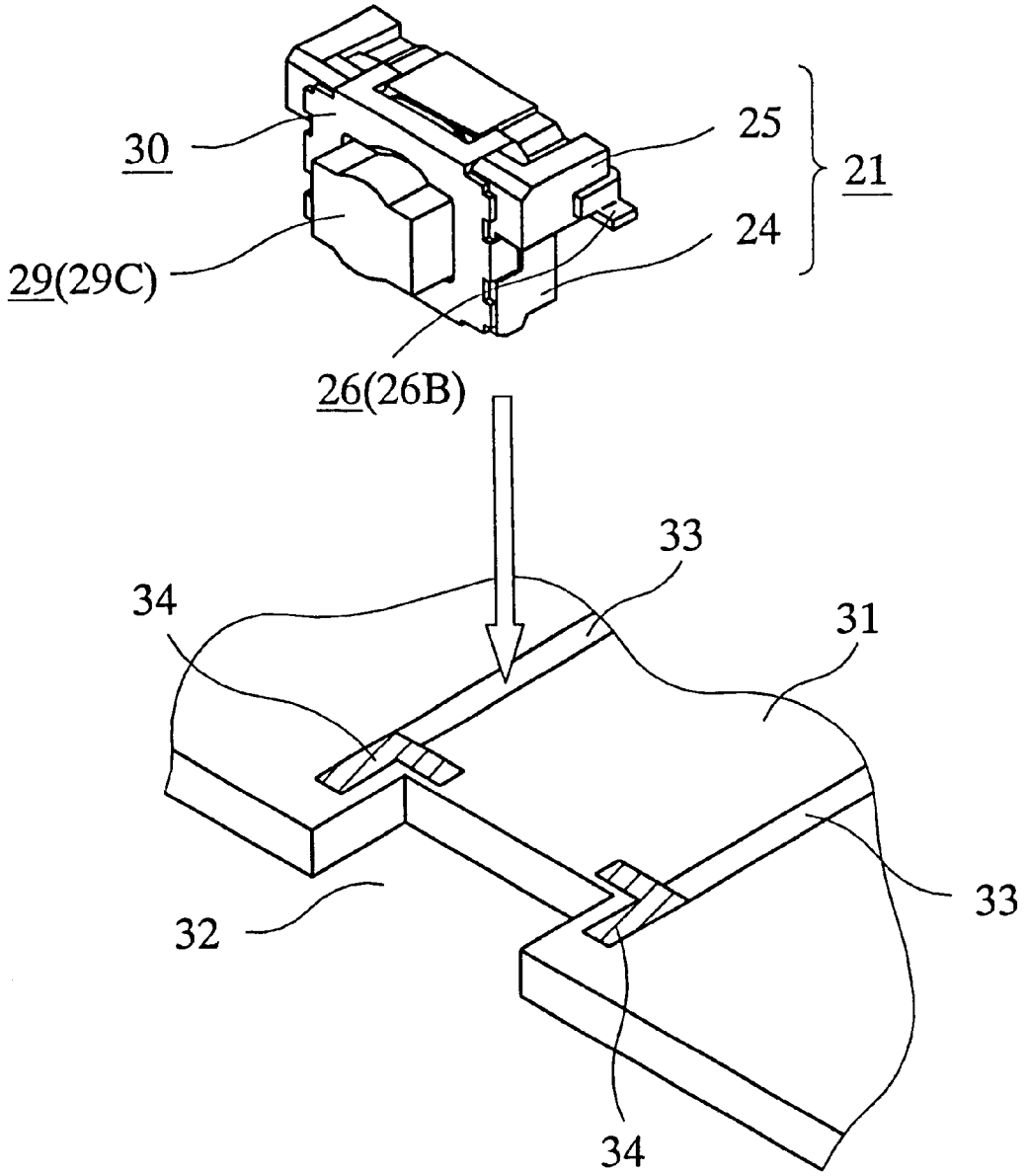
FIG. 5A is a perspective view showing a method for mounting the push-on switch.
Figure 5B:
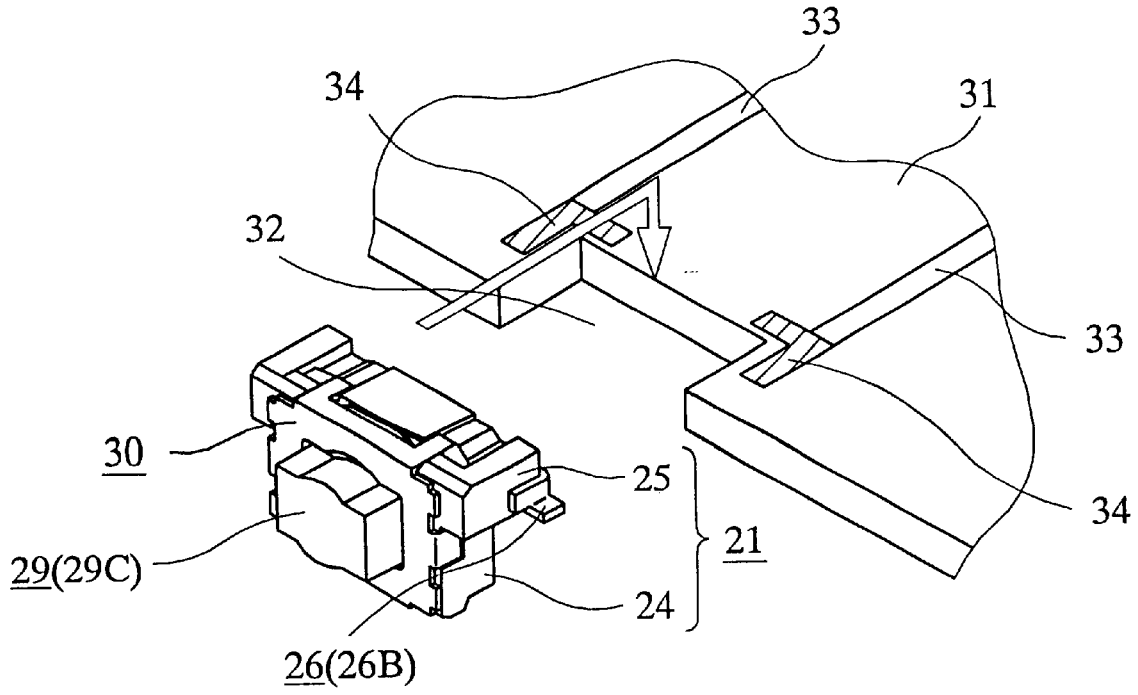
FIG. 5B is a perspective view showing another method for mounting the push-on switch.

FIGS. 5A and 5B show methods for mounting a push-on switch in the present exemplary embodiment onto a printed circuit board. There are two methods for mounting, as shown respectively in FIG. 5A and FIG. 5B.

A first method for mounting is shown in FIG. 5A. A rectangular cut 32 slightly larger than the size of case 21 in the region of main body 24 is provided in the front end of printed circuit board 31. The cut 32 has a width slightly greater than a width of the main body 24, and a depth substantially identical to a depth of the main body 24 including the thickness of cover 30. Two lands 34 are provided on the printed circuit board 31 so that they respectively surround the cut comers, and the lands 34 are each connected with a circuit pattern 33 formed on the printed circuit board 31.

A push-on switch is held at the overhang 25 provided in the upper part of case 21 to be positioned so that the region of main body 24 is just above the cut 32 of printed circuit board 31.

Figure 6:
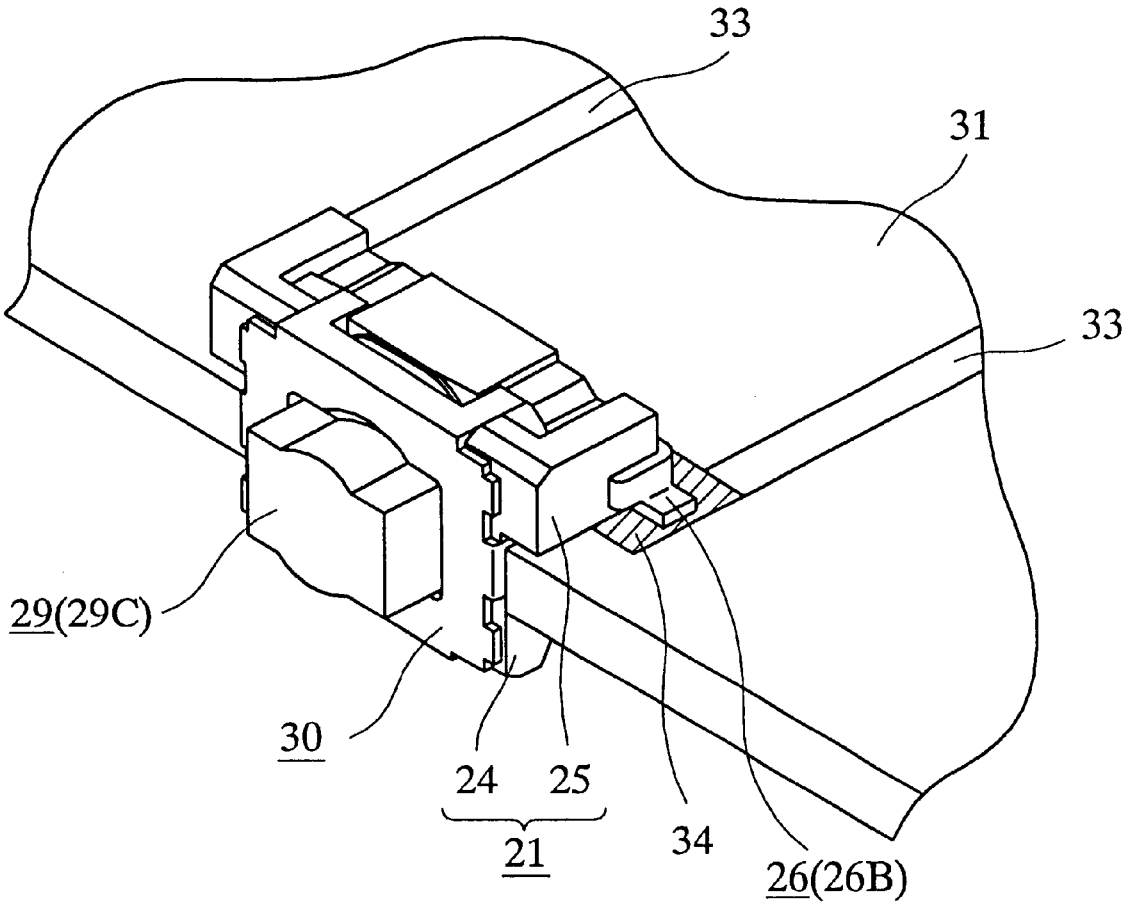
FIG. 6 is a perspective view in part of an electronic apparatus, showing a state where the push-on switch is mounted on a printed circuit board.

And then, it is lowered as indicated by an arrow to have the region of main body 24 inserted in the cut 32, until the bottom surface of overhang 25 comes in contact with the upper surface of printed circuit board 31. Then, as shown in FIG. 6, the terminal 26 provided in the overhang 25 is positioned on the land 34 of printed circuit board 31, and the back wall surface of case 21 in the region of main body 24 is in contact against the end-face of the cut 32.

Finally, after the terminal 26 is connected to the land 34, an electronic apparatus is completed with the operating part 29C protruded from the front edge of printed circuit board 31.

Since the terminal 26 is provided with the extrusion part 26B, a push-on switch mounted on printed circuit board 31 can be soldered with a broader space to have a high connection strength, even when it is soldered by reflow soldering. Thus a rigid and stable connection can be produced through a reduced number of process steps.

It is preferred to provide the land 34 on printed circuit board 31 with a slight space from the corner of the cut 32. Forming the land 34 in the above-described pattern arrangement will prevent cream solder, etc. from oozing out into the space of the cut 32. This contributes to providing a stable mounting quality.

The cut 32 may be tapered narrower towards its lower part, with the case 21 also provided with the corresponding taper in the region of main body 24. The above-described arrangement eases mounting operation of a push-on switch on a printed circuit board; namely, even if the starting position of a push-on switch is slightly dislocated, it will proceed along the tapered slope of the end-face, eventually reaching to an exact position.

It is preferred to make the width of the cut 32, where rectangular cut 32 and side surfaces of the case 21 make contact in the region of main body 24, only slightly larger than the width of the region of main body 24. Under the above-described arrangement, the sides in the region of main body 24 are supported firmly by the end-faces of the rectangular cut 32. Thus the play can be minimized, and the push-on switches can be mounted at high placement accuracy.

A second method for mounting a push-on switch in the present embodiment is shown in FIG. 5B. A push-on switch is held at the overhang 25, and the case 21 in the region of main body 24 is inserted horizontally into the rectangular cut 32 from the front as indicated by an arrow. The bottom surface of overhang 25 is kept slightly off the upper surface of printed circuit board 31.

When the back surface of the case in the region of main body 24 touches the rear end-face of cut 32, the horizontal inserting motion is stopped, and then the push-on switch is lowered as indicated by the arrow until the bottom surface of overhang makes contact with the upper surface of printed circuit board 31, as shown in FIG. 6.

Finally when the terminal 26 is connected with the land 34, an electronic apparatus is completed, with the operating part 29C protruding from the front edge of printed circuit board 31.

In accordance with the present method, a push-on switch in the region of main body 24 is first inserted in to a specified location inside the cut 32 of printed circuit board 31, and then lowered for fixing. Therefore, the back end of a push-on switch can easily be brought to make contact with the rear end-face of the cut 32.

The cut 32 may be shaped so that the gap between the end-faces gets narrower towards the rear end, with the case 21 also provided with a corresponding form in the region of main body 24. The above arrangement eases mounting of a push-on switch on a printed circuit board; namely, even if the starting position of the region of main body 24 is slightly dislocated, it proceeds along the narrowing end-faces of the cut 32, eventually reaching an exact location.

As described in the foregoing, a push-on switch in the present embodiment is mounted on a printed circuit board 31 with only its portion of the overhang 25 protruded above the printed circuit board 31. So, it will provide an electronic apparatus with additional room for further downsizing and thinning.

Figure 7A:
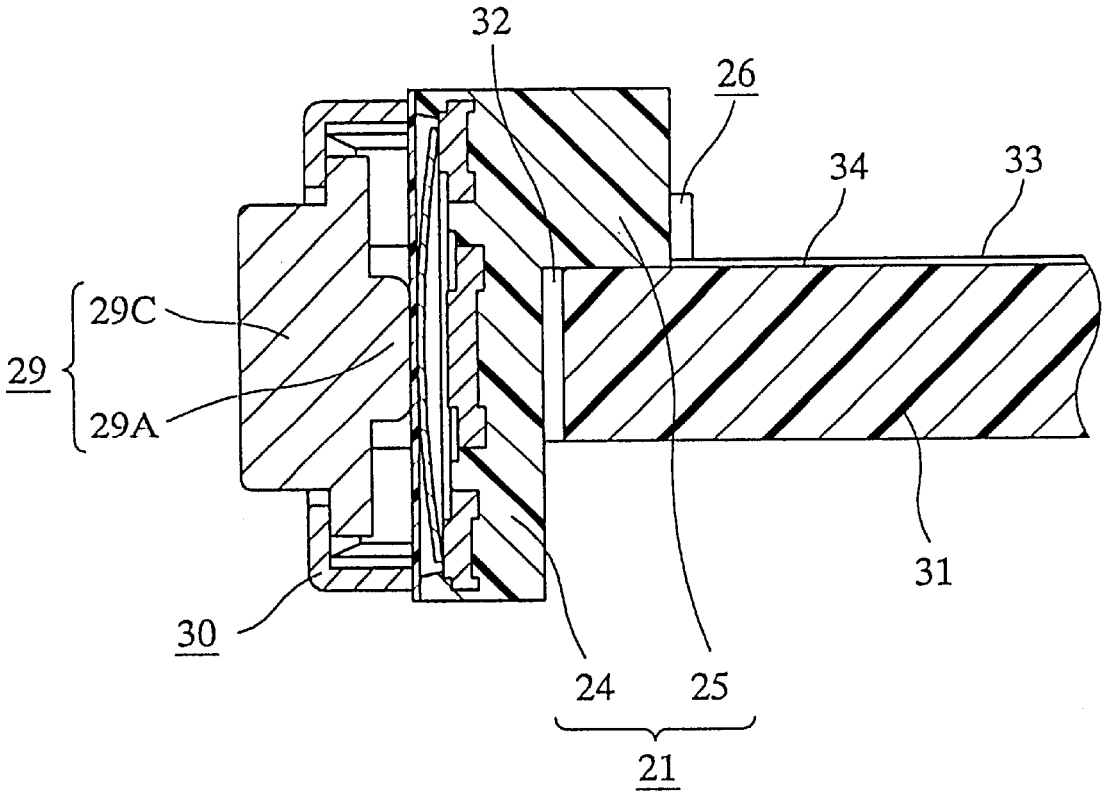
FIG. 7A is a cross-sectional view showing a state where the push-on switch is put on a printed circuit board with a slight dislocation.
Figure 7B:
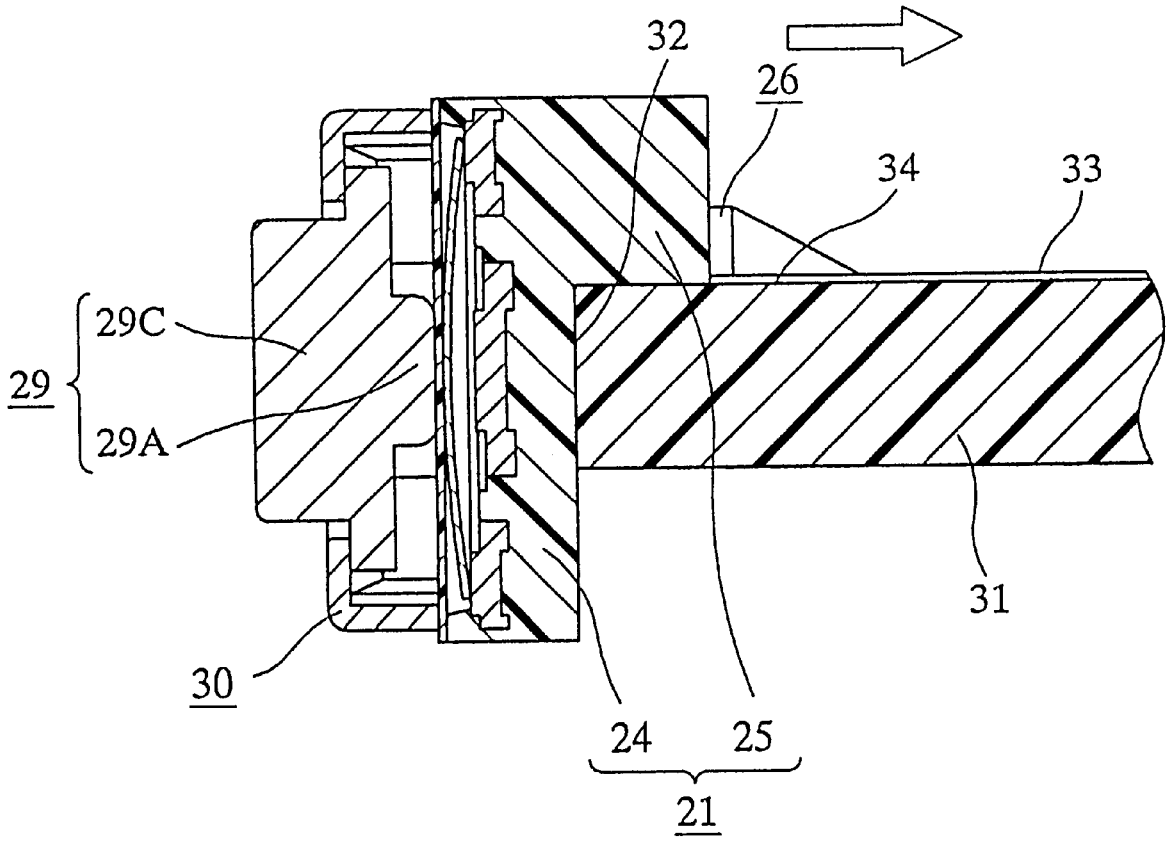
FIG. 7B is a cross-sectional view showing a state after the push-on switch is mounted and soldered on a printed circuit board.

Forming a land 34 over an extended area, in a rearward direction away from the push-on switch, may work as a good remedy for a case as shown in FIG. 7A, where a push-on switch is inadvertently placed on a printed circuit board 31 slightly dislocated towards the front, or a once-located push-on switch is slightly dislocated during transfer to the next process step during a manufacturing process. With the above-described land 34 of an extended area, a slightly-dislocated push-on switch may be pulled back as indicated by an arrow of FIG. 7B when it is soldered, by the effect of surface tension of the solder. Namely, the push-on switches may be self-aligned to the exact position in the cut 32 of printed circuit board 31. Thus good mounting quality is obtained.

Since the bottom surface of overhang 25 is kept in close contact with the printed circuit board 31 and the back surface in the region of main body 24 is touching the rear end-face of cut 32, operating force exerted in parallel with the printed circuit board 31 on the operating body 29 is encountered by the rear end-face of the rectangular cut 32 via the region of main body 24. Therefore, the soldered portion connecting the land 34 and terminal 26 does not have an undesirable mechanical load applied thereto. Reliable electrical ON/OFF performance can be expected over a long period of time, even after pressing actions are repeatedly exerted on the push-on switch.

Furthermore, by adjusting the thickness of the overhang 25 so that the approximate center of pushing part 29A substantially coincides with the center of printed circuit board 31 in its thickness direction, the operating force can be better absorbed by the printed circuit board. Under the above-described arrangement, stress on the portion of connection terminal 26 can be reduced still further. Thus a connection stability of the push-on switch with a printed circuit board 31 is improved a step further.

Although the above description has been made only with examples where the push-on switches are mounted with their operating parts 29C protruded from the front edge of a printed circuit board 31, an entire part of the push-on switch including the operating part 29C may be mounted instead behind the front edge of a printed circuit board 31, so that it is operated using an operating member provided in the apparatus side. Or, instead of mounting a push-on switch in a rectangular cut 32, it may be mounted, for example, in the inside of a through hole of a certain specific form provided in a printed circuit board 31. Irrespective of the method of mounting, the push-on switch of the present embodiment makes a significant contribution to the downsizing of electronic apparatus.

The above-described methods for mounting may be applied also to other kinds of electronic components besides the push-on switches of the present invention. The mounting method can be readily used for any of the electronic components that have an overhang in the upper part of the case, where the overhang stretches horizontally in the sidewise directions for a distance greater than the size of main body region of the case and is provided with terminals for connection.

The push-on switch in the present embodiment contains an interposed insulating sheet 28. However, it is not an essential constituent. By eliminating it, the number of components and the manufacturing process steps becomes less, and the total cost lower.

Second Embodiment

Figure 8:
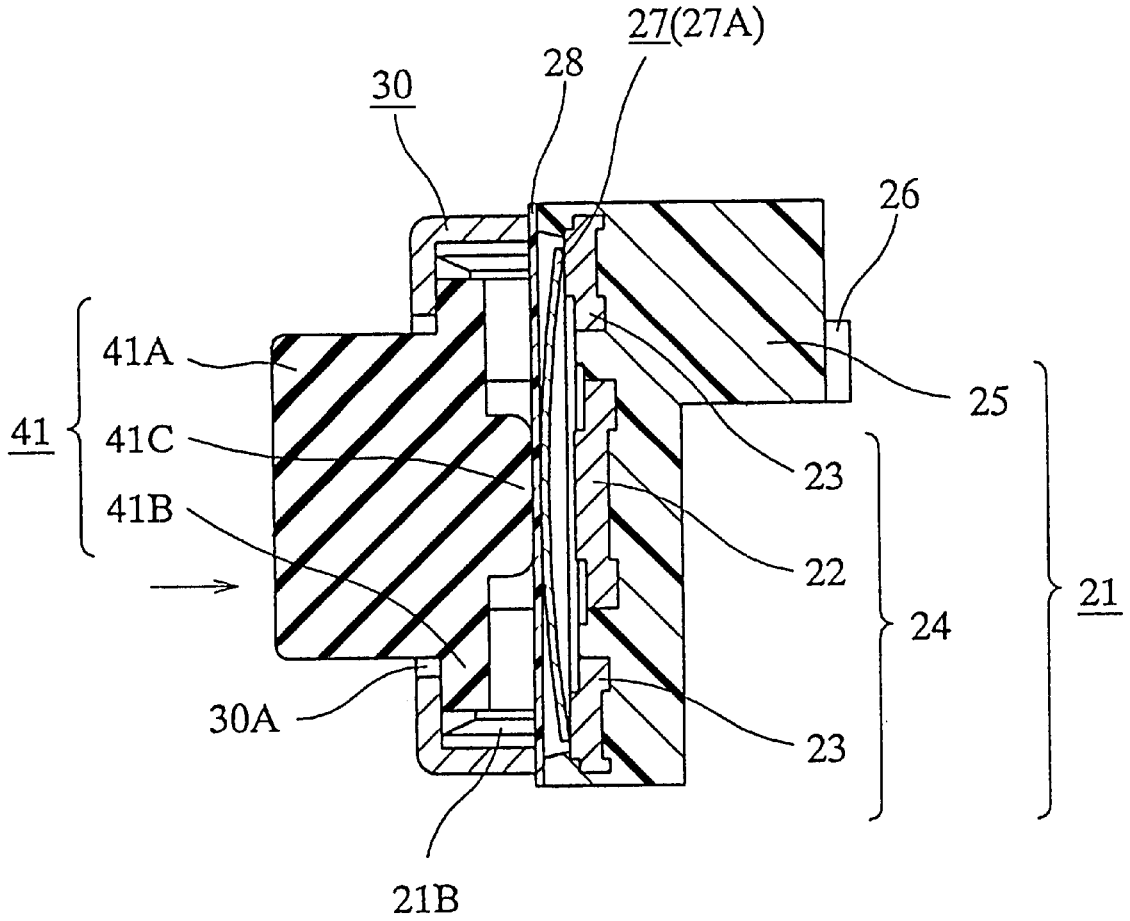
FIG. 8 is a cross-sectional view of a push-on switch in a second exemplary embodiment of the present invention.

FIG. 8 shows a cross-sectional side view of a push-on switch in a second exemplary embodiment of the present invention. The only difference from the first embodiment is that the operating body 41 is made of an elastic material in the present embodiment. The remaining portions are the same as those of the first embodiment; so, the detailed description of the remaining portions is not repeated.

A rubber material, an elastomer or other elastic resin materials can be used for the operating body 41.

As shown in FIG. 8, the operating body 41 is supported by a cover 30 attached on case 21, with the operating part 41A protruding through an opening 30A of the cover 30. A front surface of flange 41B, disposed behind the operating part 41A, makes contact with the rear surface of cover 30 to regulate location of the operating body 41.

The operating body 41 moves to-and-fro in the case guided by the wall 21 B of case 21, so that the operating body 41 can push, at the pushing part 41C, the dome summit 27A via insulating sheet 28.

For the other portions, the same constituent parts as in the first embodiment are used, description of which is eliminated here.

Next, operation of the push-on switch in the present embodiment is described

Figure 9:
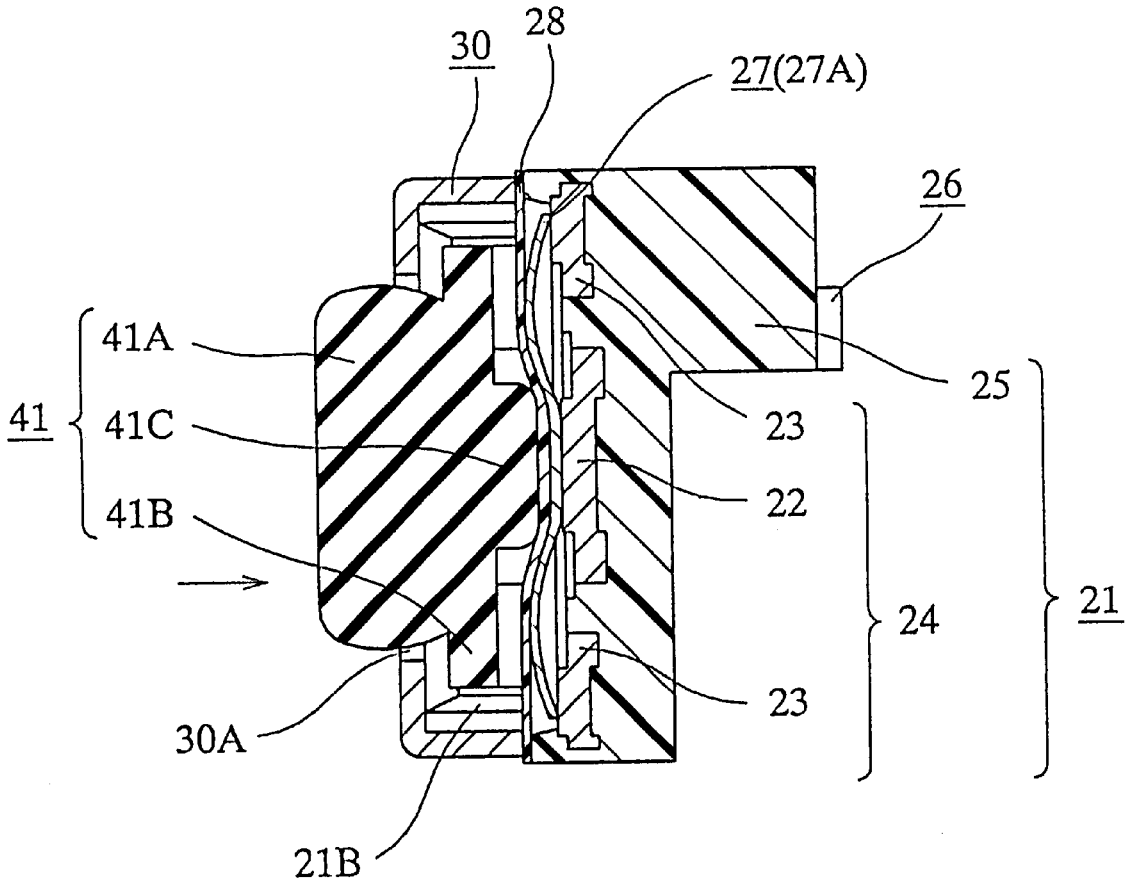
FIG. 9 is a cross-sectional view of the push-on switch in a state of being pushed.

FIG. 8 shows the switch in an OFF state. When the operating body 41 at operating part 41A is pressed in a direction as indicated with an arrow, the operating body 41 moves horizontally in the rearward direction and this accompanies a deformation due to elastic compression over a portion of the operating body 41 from operating part 41A to pushing part 41C. The pushing part 41C pushes the domed movable contact 27 at the dome summit 27A via the insulating sheet 28 and the dome summit 27A sinks. When the pressing force goes beyond a certain level, the domed movable contact 27 reverses with an accompanying click feeling to come in contact with the central fixed contact point 22 at the rear surface of dome summit 27A. Thus the central fixed contact point 22 and the outer fixed contact points 23 are brought into contact via the domed movable contact 27. The terminals 26 are electrically connected accordingly to place the push-on switch in an ON state, as shown in FIG. 9.

When the pressing force is withdrawn, the domed movable contact is 27 restored to its original shape by an elastic restorative force, and returns the operating body 41 to the initial location bringing the switch back to the OFF state as shown in FIG. 8.

Since the operating body 41 is made of an elastic material in the present embodiment, it provides a longer operating stroke including a certain length due to the deflection in operating body 41.

An appropriate material may be selected for the operating body 41 to provide desired operating stroke.

A push-on switch in the present embodiment may be fabricated so that an operating body 41 can undergo a further elastic deformation after the push-on switch is brought into an ON state; namely, the push-on switch may provide an over stroke in the pressing operation. In the above-described configuration, however, attention has to be paid to avoid applying too much load to the contact points section formed of the domed movable contact 27, central fixed contact point 22 and outer fixed contact points 23.

Furthermore, a push-on switch in the present embodiment may be assembled, by making use of the elastic force of the operating body 41, in a way that the operating body 41 itself and the domed movable contact 27 are normally pressed backward for a slight amount. Under the above-described way of fabrication, dislocating of assembled components is curtailed. Significance of this way of fabrication is revealed when the push-on switch is used in, for example, a portable electronic apparatus, where generation of abnormal sounds due to rattling of constituent components can be avoided.

The rattling sound as well as contacting noise may be prevented more effectively by disposing an apparatus side operating member always in contact with the operating part 41A of operating body 41 so that a certain amount of compression force is present therein.

A method for mounting the push-on switch of the present invention and the state after mounting on a printed circuit board remain the same as those in the first embodiment, so description thereof is omitted here.

Although the operating part 41A, the flange 41B and the pushing part 41C in the present embodiment have been formed integrally as a single-piece operating body 41, it may be fabricated otherwise. Namely, for example, first making the flange part with a solid material and then combining an elastic operating part and an elastic pushing part together; or combining an integrated elastic body constituting the operating part and the pushing part with the flange part.

Third Embodiment

Figure 10:
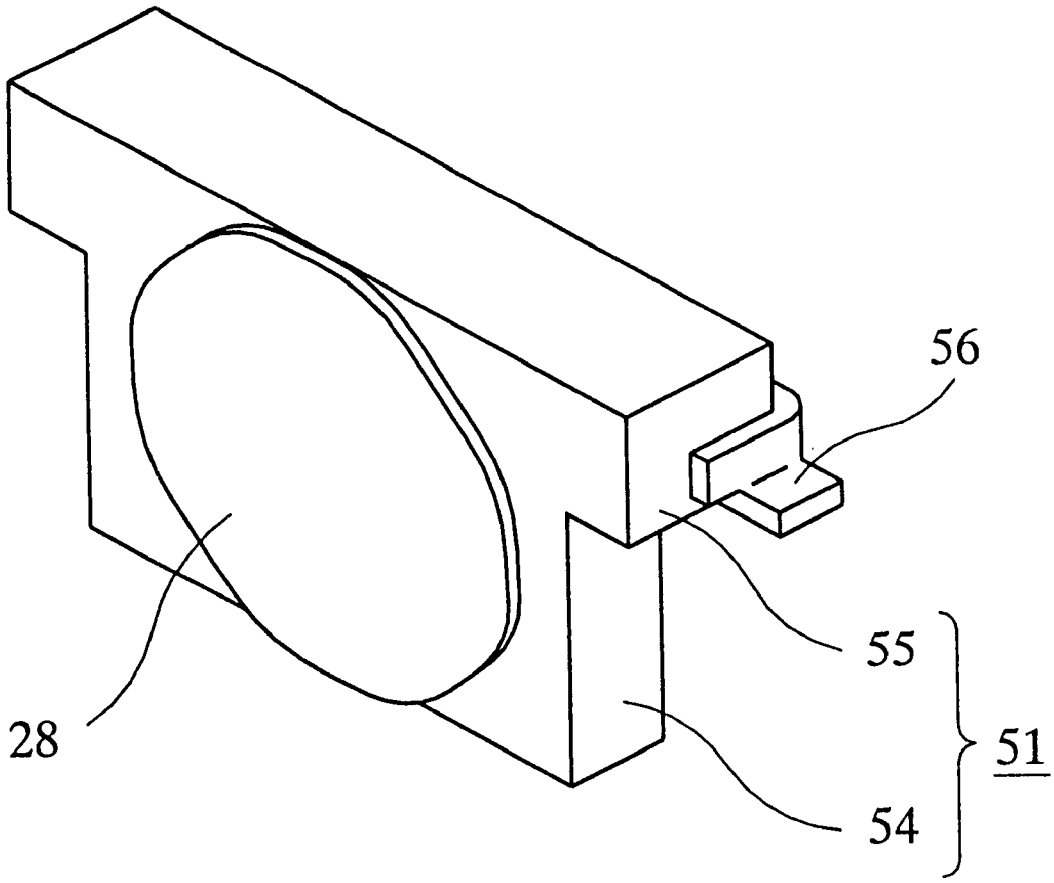
FIG. 10 is a perspective view of a push-on switch in a third exemplary embodiment of the present invention.
Figure 11:
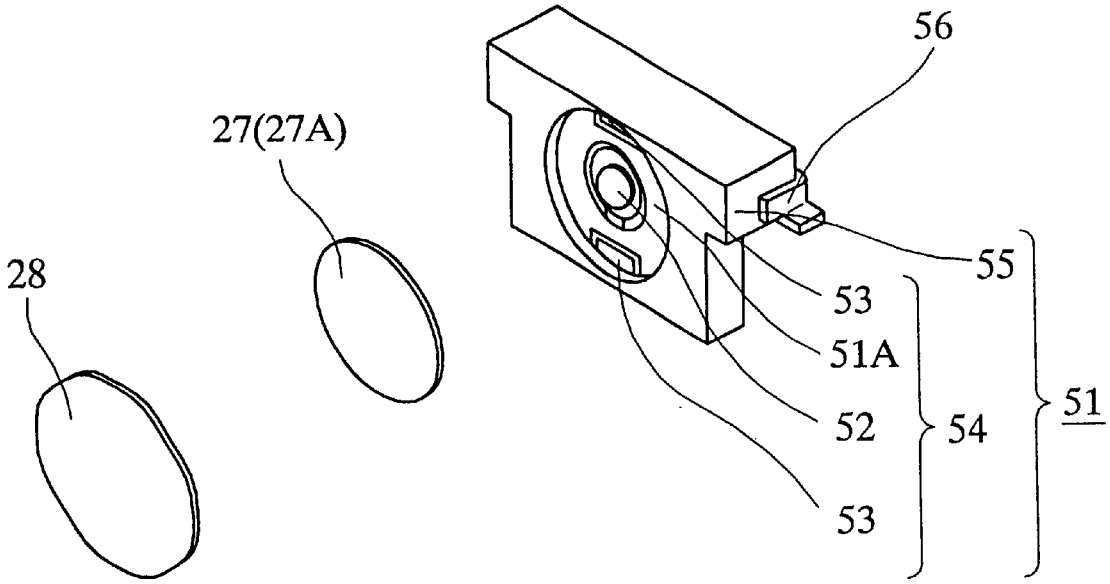
FIG. 11 is an exploded perspective view of the push-on switch.

FIG. 10 shows a perspective view of a push-on switch in a third exemplary embodiment of the present invention. FIG. 11 is an exploded perspective view of the push-on switch.

As shown in the FIGS. 10 and 11, the push-on switch in the present embodiment comes without operating body and cover, as compared with the counterpart in the first embodiment.

Namely, an insulating resin case 51 contains a main body 54 of a switch mechanism formed in a front-open recess 51A, where a central fixed contact point 52 and two outer fixed contact points 53, which are disposed symmetrically at both sides of the central fixed contact point 52, are provided integrally by an insert molding method in an inner recess of the case 51 so that these fixed contact points are exposed from a wall surface of the recess. The resin case 51 is provided with an overhang 55 which stretches horizontally in directions towards both sides and towards the rear from the resin case 51 in the upper part of a region corresponding to the region of main body 54 so as to have a size greater than the size of main body region.

The central fixed contact point 52 and the outer fixed contact points 53 are electrically connected respectively with terminals 56 provided on the overhang 55, like in the first embodiment.

A domed movable contact 27 is housed in the recess 51A of case 51 with the circumferential edge placed on the outer fixed contact points 53, so that it opposes the central fixed contact point 52 keeping a certain predetermined clearance from the reverse surface of the dome summit 27A. And a flexible insulating sheet 28 is provided for sealing the recess 51A closed and supporting the domed movable contact 27 at the front surface at the dome summit 27A for regulating the location. the basic structure remains the same as that in the first embodiment.

The above-configured push-on switch operates on the same basic principle s the first embodiment. So, only a brief description is made here.

Since the push-on switch in the present embodiment has no operating part appearing outside, it is operated by operating pressure given, via insulating sheet 28, to the domed movable contact 27 using an apparatus side operating member (not shown).

When the pressing force goes beyond a certain level, the domed movable contact 27 reverses and is accompanied by a click feeling to come into contact with the central fixed contact point 52 at the rear surface at dome summit 27A. Thus the central fixed contact point 52 and the outer fixed contact points 53 are brought into electrical contact, and the corresponding terminals 26 are brought into electrical contact.

When the operating pressure is withdrawn, the domed movable contact 27 is restored to its original shape by an elastic restorative force, and the switch returns to an OFF state.

The method for mounting the push-on switch in the present embodiment and the state after mounting on a printed circuit board are the same as in the first embodiment. So, description of thereof omitted here.

As described above, the push-on switches in the present embodiment can be provided using fewer components, and the shape of case 51 can be much simplified, as compared with the first embodiment. Thus a push-on switch that is cheaper and superior in operational function is provided.

Fourth Embodiment

Figure 12:
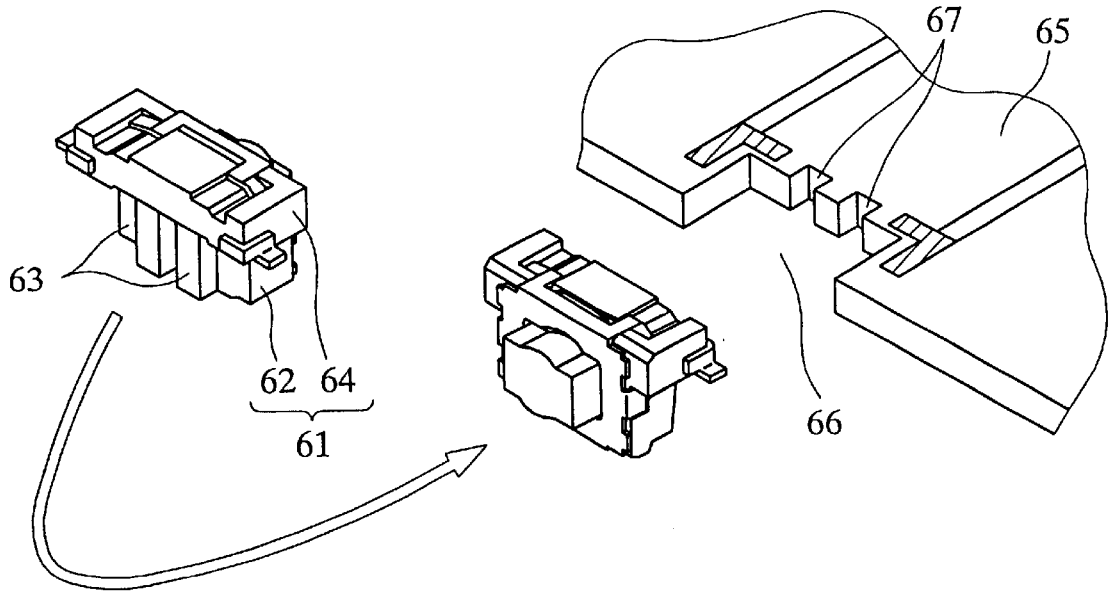
FIG. 12 is a perspective view in part of an electronic apparatus, showing how a push-on switch in a fourth exemplary embodiment is mounted thereon.

FIG. 12 is a perspective view showing a push-on switch and an electronic apparatus in part, or a printed circuit board on which the switch is mounted, in a fourth exemplary embodiment of the present invention. As compared with that in the first embodiment, a case 61 of the present embodiment is provided with a protrusion 63 for forming a protrusion/recess area in the region of main body 62.

The protrusion 63 is provided in two places symmetrically located at both sides of the center line with respect to the width of the case 61; the protrusions 63 reach upward to an overhang 64, and downward to the level of a skirt line of case 61.

As to the structure of other parts and the operation, they remain the same as in the first embodiment. So, description thereof is omitted here.

As shown in FIG. 12, a cut 66 of a printed circuit board 65 is provided at the rear end with recesses 67 for accepting protrusions 63 of case 61.

The push-on switch in the present embodiment is mounted on the printed circuit board 65 with the protrusions 63 engaged in the recesses 66. By being mounted as above, the push-on switch can be held firmly in the place until it is finally fixed by soldering.

When an operating force is exerted in an oblique direction, movement of the switch is resisted by an engaged structure formed of the protrusions and the recesses, besides a pair of side-faces of the cut 66. Thus the stress due to the oblique force is better absorbed in the present embodiment by the engaged structure, to provide an enhanced mounting strength.

Since the engaged structure keeps the push-on switch fixed firmly at the central zone including its right and left vicinities, where the influence of operating force is the greatest, the mounting stability is significantly increased. Shape, location, numbers, etc. of the engaging structure are optional.

Fifth Embodiment

Figure 13:
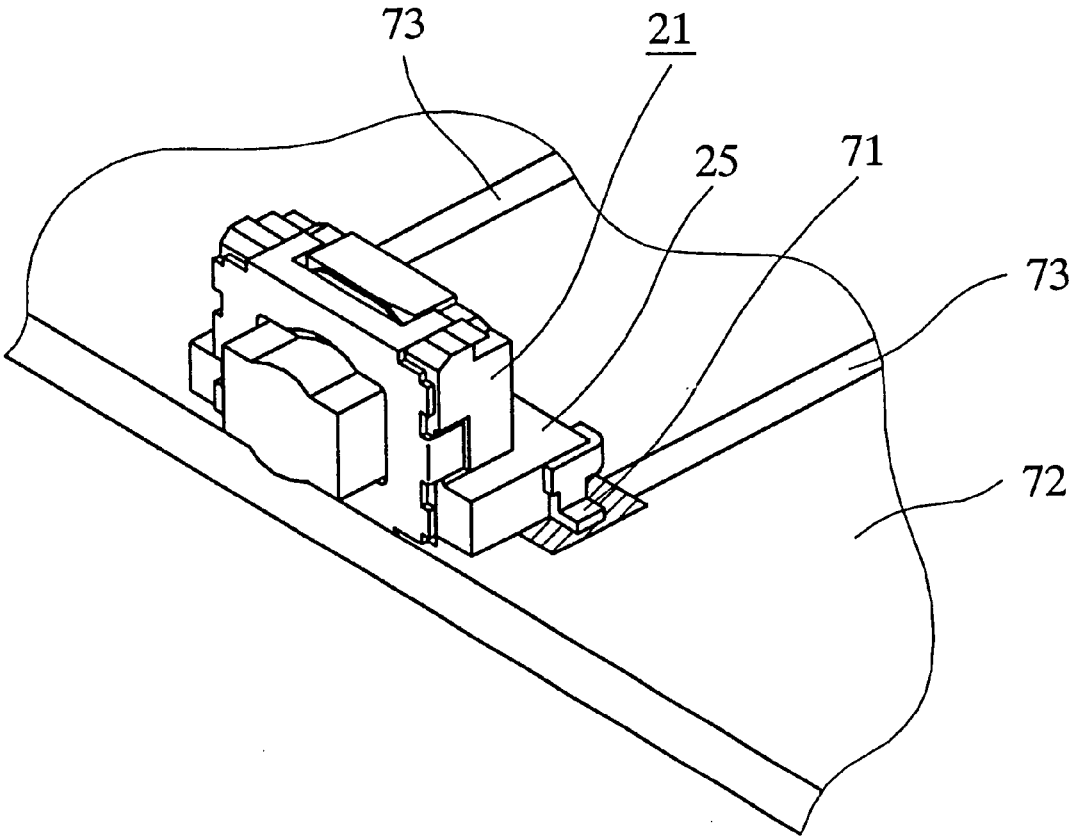
FIG. 13 is a perspective view in part of an electronic apparatus, showing a state after a push-on switch in a fifth exemplary embodiment is mounted on the printed circuit board.

FIG. 13 is a perspective view in part of an electronic apparatus, showing a push-on switch in a fifth exemplary embodiment of the present invention mounted on a printed circuit board. The push-on switch in the present embodiment differs from the first embodiment in the way a terminal 71 is provided and in the method by which it is mounted on a printed circuit board.

The push-on switch in the present embodiment is mounted on a printed circuit board in a way such that a push-on switch similar to that in the first embodiment is held upside down. Namely, the top surface of the overhang 25 of case 21 in the first embodiment is positioned at the bottom in the present embodiment, and the bottom surface is placed in contact with the upper surface of printed circuit board 72 to be fixed thereon.

In the present embodiment, a connection terminal 71 provided in the overhang 25 is devised so that it can be connected and fixed by soldering on a circuit pattern 73 of printed circuit board 72.

As to the structure of other parts and the operation, they remains the same as in the first embodiment. So, no detailed description thereof is repeated here.

Since the push-on switch in the present embodiment is disposed on a printed circuit board 72 with the broad contact area of the overhang 25 down, it can stand alone by itself in a stable manner. This means that the soldering and other procedures can be performed with ease, because the push-on switch is positioned stably thereon. And the operating forces may be dispersed by the broad contact area, so the push-on switch does not easily topple down.

Furthermore, the printed circuit board 72 does not need to be provided with a rectangular cut in the present embodiment, which saves a processing cost.

Figure 14:
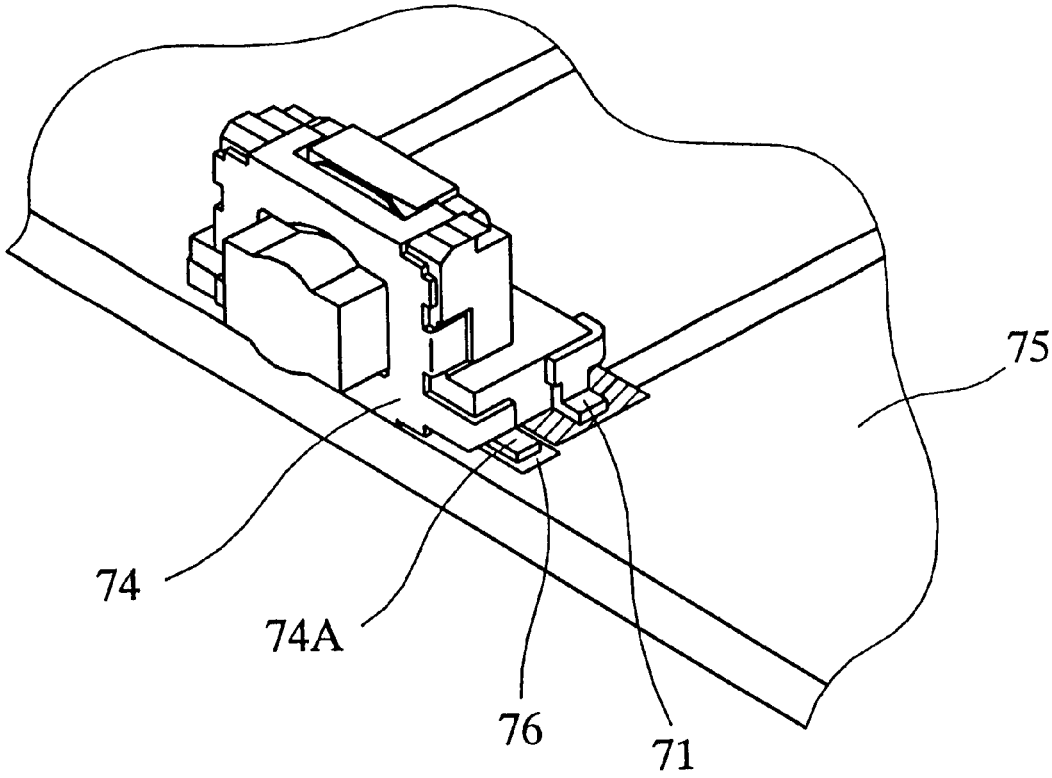
FIG. 14 is a perspective view of another example, showing a state after mounting.
Figure 15:
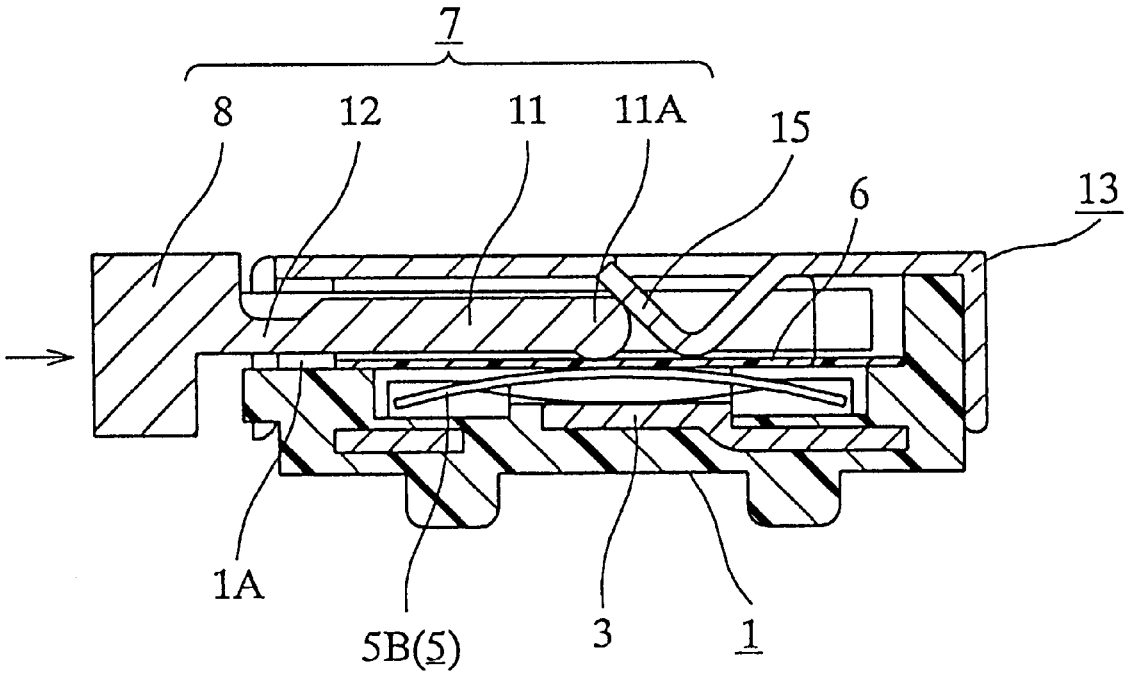
FIG.15 Prior Art
FIG. 15 is a cross-sectional view of a conventional push-on switch.
Figure 16:
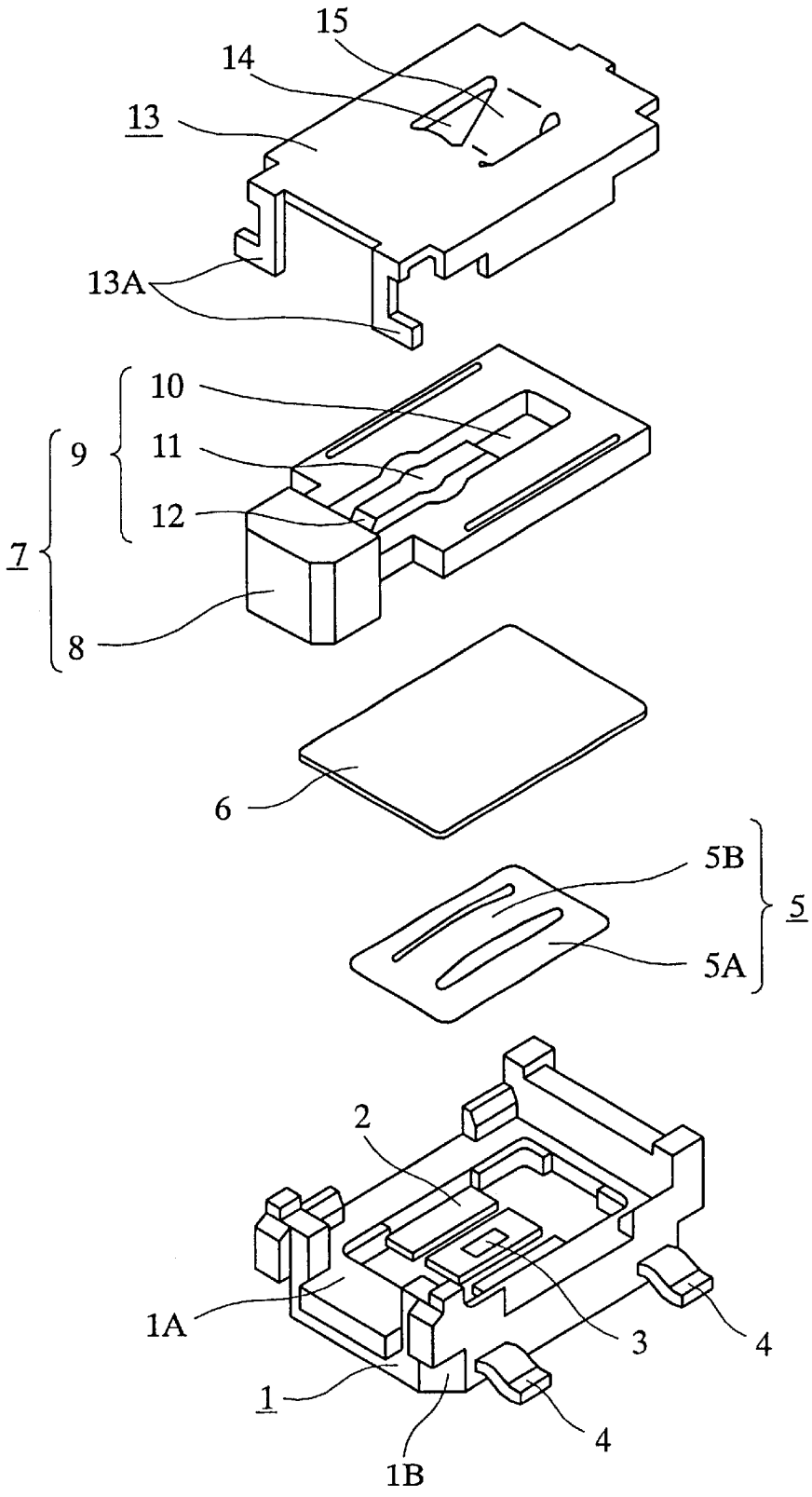
FIG.16 Prior Art
FIG. 16 is an exploded perspective view of the conventional push-on switch.

Still further, the cover 74 may be provided with a reinforcement terminal 74A, as shown in FIG. 14, in addition to the terminal 71. When the reinforcement terminal 74A is soldered and fixed on a land 76 of printed circuit board 75, the mounted strength is further enhanced. The reinforcement terminal 74A may be utilized also for an anti-electrostatic purpose by electrically connecting the land 76 with the grounding line of the electronic apparatus.

As described in the foregoing, the present invention provides a side-push type push-on switch having a superior operational property. It is mounted and fixed on a printed circuit board with a structure where an operating force is encountered by the end-face of the printed circuit board.

Furthermore, mold machining, manufacturing of constituent components, etc. can be conducted with ease and be less expensive in the present invention even when the push-on switches are miniature-size.

Electronic apparatus can still be downsized and thinned by introducing the push-on switches of the present invention.

What is claimed is:

1. A push-on switch comprising:

a case made of an insulating resin and including a main body and an overhang that protrudes outwardly beyond said main body at an upper part of said main body so as to have a size greater than said main body, said case having a forwardly-opening recess;

a central fixed contact point and an outer fixed contact point mounted to said case and exposed in said recess;

a domed movable contact made of an elastic thin metal sheet housed in said case and having an outer circumference disposed on said outer fixed contact point;

an operating body mounted to said case so that said operating body can move said domed movable contact;

a cover attached to said case and supporting said operating body; and terminals provided in said overhang and electrically coupled with said central fixed contact point and said outer fixed contact point, respectively.

2. The push-on switch of claim 1, wherein said domed movable contact is positioned and held to the case by an insulating flexible sheet provided with one of a sticking agent layer and a pressure sensitive adhesive layer.

3. The push-on switch of claim 1, wherein said operating body is provided with an operating part protruding forward through an opening of said cover.

4. The push-on switch of claim 3, wherein said operating body is formed of elastic material.

5. The push-on switch recited in claim 1, wherein each of said terminals provided in said overhang of said case has an additional portion extending in parallel to said overhang.

6. An electronic apparatus including a printed circuit board having a cutout portion, and a push-on switch, said push-on switch comprising:

a case made of an insulating resin and including a main body and an overhang that protrudes outwardly beyond said main body at an upper part of said main body so as to have a size greater than said main body, said case having a forwardly-opening recess;

a central fixed contact point and an outer fixed contact point mounted to said case and exposed in said recess;

a domed movable contact made of an elastic thin metal sheet housed in said case and having an outer circumference disposed on said outer fixed contact point;

an operating body mounted to said case so that said operating body can move said domed movable contact;

a cover attached to said case and supporting said operating body; and terminals provided in said overhang and electrically coupled with said central fixed contact point and said outer fixed contact point, respectively, wherein said push-on switch is mounted on said printed circuit board in a manner such that said case, in a region corresponding to said main body, fits in said cutout portion of said printed circuit board while a bottom surface of said overhang keeps close contact with an upper surface of said printed circuit board, and said terminals provided in said overhang are connected to circuit patterns formed on said printed circuit board.

7. The electronic apparatus of claim 6, wherein the cutout portion of said printed circuit board is shaped to have an opposing pair of end-faces spaced apart by a dimension slightly larger than a width of said main body, and said opposing pair of end-faces support the sides of said case at said main body thereof.

8. The electronic apparatus of claim 6, wherein a land is provided on said printed circuit board and is slightly spaced from an edge of said cutout portion of said printed circuit board.

9. The electronic apparatus recited in claim 6, wherein a back wall of said main body makes contact with an end-face of said cutout portion of said printed circuit board.

10. The electronic apparatus of claim 9, wherein said back wall of said main body is formed to have a specific pattern of at least one protrusion and at least one recess, and said printed circuit board is provided at a contact edge in said cutout portion with a counterpart pattern to be engaged with said specific pattern.

11. The electronic apparatus of claim 10, wherein a center of said push-on switch is coplanar with a center of said printed circuit board in a direction of thickness.

12. The electronic apparatus recited in claim 9, wherein a land is provided on said printed circuit board for connection with one of said terminals of said push-on switch for an extended space stretching rearwardly.

13. An electronic apparatus including a printed circuit board having a cutout portion, and a push-on switch, said push-on switch comprising:

a case made of an insulating resin and including a main body and an overhang that protrudes outwardly beyond said main body at an upper part of said main body so as to have a size greater than said main body, said case having a forwardly-opening recess;

a central fixed contact point and an outer fixed contact point mounted to said case and exposed in said recess;

a domed movable contact made of an elastic thin metal sheet housed in said case and having an outer circumference disposed on said outer fixed contact point;

an operating body mounted to said case so that said operating body can move said domed movable contact;

a cover attached to said case and supporting said operating body; and terminals provided in said overhang and electrically coupled with said central fixed contact point and said outer fixed contact point, respectively, wherein said push-on switch is mounted on a printed circuit board with said overhang of said case in contact thereon, and at least one of said terminals provided in said overhang is connected with a circuit pattern formed on an upper surface of said printed circuit board.

14. A method for mounting a push-on switch on a printed circuit board, said push-on switch comprising a case made of an insulating resin and including a main body and an overhang that protrudes outwardly beyond said main body at an upper part of said main body so as to have a size greater than said main body, said case having a forwardly-opening recess, a central fixed contact point and an outer fixed contact point mounted to said case and exposed in said recess, a domed movable contact made of an elastic thin metal sheet housed in said case and having an the outer circumference disposed on said outer fixed contact point, an operating body mounted to said case so that said operating body can move said domed movable contact, a cover attached to said case and supporting said operating body, and terminals provided in said overhang and electrically coupled with said central fixed contact point and said outer fixed contact point, respectively, said method comprising:

inserting said main body of said push-on switch from the upper side into a cutout portion provided at an end of said printed circuit board until a bottom surface of said overhang of said case reaches to make contact with an upper surface of said printed circuit board; and connecting at least one of said terminals to a circuit pattern formed on said upper surface of said printed circuit board.

15. A method for mounting a push-on switch on a printed circuit board, said push-on switch comprising a case made of an insulating resin and including a main body and an overhang that protrudes outwardly beyond said main body at an upper part of said main body so as to have a size greater than said main body, a central fixed contact point and an outer fixed contact point mounted to said case and exposed in said recess, a domed movable contact made of an elastic thin metal sheet housed in said case and having an outer circumference disposed on said outer fixed contact point, an operating body mounted to said case so that said operating body can move said domed movable contact, a cover attached to said case and supporting said operating body, and terminals provided in said overhang and electrically coupled with said central fixed contact point and said outer fixed contact point, respectively, said method comprising:

inserting said main body of said push-on switch from the front into a cutout portion provided at an end of said printed circuit board to a certain predetermined location;

lowering said case until a bottom surface of said overhang of said case contacts on an upper surface of said printed circuit board; and connecting at least one of said terminals to a circuit pattern formed on said upper surface of said printed circuit board.

16. The push-on switch of claim 2, wherein said operating body is provided with an operating part protruding forward through an opening of said cover.

17. The push-on switch recited in claim 2, wherein each of said terminals provided in said overhang of said case has an additional portion extending in parallel to said overhang.

18. The push-on switch recited in claim 3, wherein each of said terminals provided in said overhang of said case has an additional portion extending in parallel to said overhang.

19. The push-on switch recited in claim 4, wherein each of said terminals provided in said overhang of said case has an additional portion extending in parallel to said overhang.

20. The electronic apparatus of claim 7, wherein a land is provided on said printed circuit board and is slightly spaced from an edge of said cutout portion of said printed circuit board.

21. The electronic apparatus recited in claim 7, wherein a back wall of said main body makes contact with an end-face of said cutout portion of said printed circuit board.

22. The electronic apparatus recited in claim 8, wherein a back wall said main body makes contact with an end-face of said cutout portion of said printed circuit board.

23. The electronic apparatus recited in claim 10, wherein a land is provided on said printed circuit board for connection with one of said terminals of said push-on switch for an extended space stretching rearwardly.

24. The electronic apparatus recited in claim 11, wherein a land provided on said printed circuit board for connection with one of said terminals of said push-on switch for an extended space stretching rearwardly.

* * * * *

UNITED STATES PATENT AND TRADEMARK OFFICE

CERTIFICATE OF CORRECTION

PATENT NO. : 6,489,580 B2
DATED : December 3, 2002
INVENTOR(S) : Yasunori Yanai et al.

It is certified that error appears in the above-identified patent and that said Letters Patent is hereby corrected as shown below:

Column 16,
Line 5, “back wall said main body” should read -- back wall of said main body --; and
Line 12, “a land provided” should read -- a land is provided --.

Signed and Sealed this

Twenty-ninth Day of April, 2003

JAMES E. ROGAN
*Director of the United States Patent and Trademark Office*